US006454001B1

(12) United States Patent
Thompson et al.

(10) Patent No.: US 6,454,001 B1
(45) Date of Patent: Sep. 24, 2002

(54) METHOD AND APPARATUS FOR PLUGGING WELLS

(75) Inventors: Tommy D. Thompson, Houston; Horton C. Ballew, Montgomery; James F. Heathman, Katy; David L. Thorp, Victoria, all of TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/569,652

(22) Filed: May 12, 2000

(51) Int. Cl.[7] ..... E21B 33/134; E21B 33/136

(52) U.S. Cl. ..... 166/250.14; 166/135; 166/177.4; 166/202; 166/290; 166/387

(58) Field of Search ..... 166/135, 177.4, 166/193, 202, 250.01, 250.14, 285, 286, 290, 297, 387

(56) References Cited

U.S. PATENT DOCUMENTS

| | | | | | |
|---|---|---|---|---|---|
| 1,676,785 | A | * | 7/1928 | Lewis | 166/286 |
| 2,357,145 | A | * | 8/1944 | Standefer | 166/202 X |
| 2,888,078 | A | * | 5/1959 | Lebourg | 166/290 |
| 2,929,455 | A | * | 3/1960 | Godbey | 166/202 X |
| 3,134,440 | A | * | 5/1964 | Nelson | 166/290 X |
| 3,380,534 | A | * | 4/1968 | Hall et al. | 166/177.4 X |
| 3,570,603 | A | * | 3/1971 | Kammerer, Jr. et al. | 166/290 |
| 3,872,925 | A | * | 3/1975 | Owen et al. | 166/286 |
| 3,955,625 | A | | 5/1976 | Hughes et al. | 166/202 |
| 4,421,169 | A | | 12/1983 | Dearth et al. | 166/285 |
| 4,469,174 | A | | 9/1984 | Freeman | 166/202 |
| 4,491,178 | A | | 1/1985 | Terrell et al. | 166/192 |
| 4,545,433 | A | | 10/1985 | Wambaugh | 166/105 |
| 4,554,973 | A | | 11/1985 | Shonrock et al. | 166/192 |
| 4,576,042 | A | | 3/1986 | Johnson | |
| 4,671,356 | A | | 6/1987 | Barker et al. | 166/285 |
| 4,791,988 | A | | 12/1988 | Trevillion | 166/285 |
| 5,010,958 | A | | 4/1991 | Meek et al. | 166/382 |
| 5,667,015 | A | | 9/1997 | Harestad et al. | 166/383 |
| 5,671,809 | A | * | 9/1997 | McKinzie | 166/285 |
| 6,006,836 | A | | 12/1999 | Chatterji et al. | 166/295 |

OTHER PUBLICATIONS

Article entitled "How through–tubing bridge plugs work" by Robert W. Scott, *World Oil*, Oct., 1959.

Monograph entitled "Cementing" by Dwight K. Smith, pp. 78–80 and 142, Henry L. Doherty Memorial Fund of AIME, Society of Professional Engineers, Inc., 1990.

* cited by examiner

*Primary Examiner*—George Suchfield
(74) *Attorney, Agent, or Firm*—Craig W. Roddy; Anthony L. Rahhal

(57) ABSTRACT

A method and apparatus for plugging a well. The apparatus includes a well barrier which may be connected to a pipe string and lowered into a well to a selected plug location. The barrier is held in place by the pipe string at the selected plug location. The well barrier will engage the well at the selected plug location. A plugging fluid is displaced through the pipe string and is communicated into the well above the barrier. The well barrier will catch the plugging fluid. After the plugging fluid gels sufficiently to support itself in the well, the pipe string which was utilized to lower the well barrier can be disconnected from the well barrier and removed from the well after the plugging fluid has been allowed to set to a sufficient gel strength. The well barrier consists of a support pipe connected to the pipe string, and a fluid barrier connected thereto. The fluid barrier comprises a webbing disposed about the support pipe and a plurality of support members hingedly connected to the support pipe which allows the support members to rotate outwardly to engage the well at the selected plug location.

51 Claims, 4 Drawing Sheets

METHOD AND APPARATUS FOR PLUGGING WELLS

BACKGROUND OF THE INVENTION

This invention generally relates to an apparatus for plugging wells and more specifically to a barrier which can be lowered into a well on a pipe string and which will support a column of plugging fluid.

As is well known, it is often necessary to plug various types of wells. Such wells may consist of, but are not limited to, oil and gas wells, disposal wells and injection wells used for subterranean storage. These are merely examples and as is well known other types of wells must also be plugged for a variety of reasons. One common problem when plugging wells is achieving a positive bottom barrier. Very often, the well to be plugged cannot support a column of plugging fluids, such as a cement slurry.

Generally, a well is plugged by displacing a plugging fluid which can be a cement mixture or any other plugging fluid known in the art, to a supply pipe at a location where the plug is to be set. Generally, before the cement mixture or other plugging fluid is added, the well will have a fluid, such as drilling fluid therein, and the cement or other plugging fluid is carried by the drilling fluid until the cement mixture hardens. There are a number of difficulties associated with setting plugs in this manner. The plugging fluid may become mixed or contaminated with the fluid in the well, which can damage the integrity of the plugging fluid such that sufficient hardness is not reached. There are other times when plugs set in this manner end up lower than desired because the plugging fluid settles to a position lower in the wellbore than the desired plug location. Furthermore, there are times when the plug does not adequately fill the well at the plug location such that it may have a tendency to slip and/or tilt in the well.

Certain of these difficulties are addressed in U.S. Pat. No. 5,667,015 which discloses a well barrier. The barrier shown therein, however, is still susceptible to moving within a wellbore so that the plug may ultimately not be located at the desired plug location.

Thus there is a need for an apparatus and method for providing a positive bottom barrier so that the well can be effectively plugged. The barrier must be capable of supporting the hydrostatic weight of upper fluid columns that may consist of drilling muds, brines and cement slurries, and more specifically should be able to support the hydrostatic weight of a column of hydraulic cement or other plugging fluid or material. When such fluids harden, or develop substantial gel strength, the fluids are self-supporting in the well. The present invention overcomes the above-mentioned problems by providing a positive bottom barrier in an economical and time-efficient manner.

SUMMARY OF THE INVENTION

The present invention provides a method and apparatus for plugging a well. The apparatus comprises a support pipe defining a central flow passage and has a plurality of openings which intersect the central flow passage. A fluid barrier is attached to the support pipe below the plurality of openings. The fluid barrier will catch a plugging fluid displaced through the flow passage and communicated through the openings in the support pipe.

The fluid barrier may comprise a canvas material and may include a plurality of support members for supporting the canvas material. The support members may be hingedly connected to the support pipe. Thus, the fluid barrier may be movable and may be moved from a closed position when it is being lowered into a well to an open position at a selected plug location in the well.

The fluid barrier has a central opening through which the support pipe is received. Thus, the barrier is disposed about the support pipe and extends radially outwardly therefrom. Thus, in its open position the fluid barrier comprises an upwardly opening barrier that extends radially outwardly from the support pipe and will engage the well at the selected plug location. The apparatus includes a means for preventing the barrier from opening past a fully open position and also includes a means for maintaining the barrier in its open position at the selected plug location.

The support pipe may be connected to and lowered into a well by any means known in the art but is preferably lowered with tubing, jointed pipe or other string of pipe known in the art. The string of pipe is connected to the support pipe, and the central flow passage of the support pipe is communicated with a central opening or central flow passage of the string of pipe thereabove. Once the plugging apparatus has been lowered to the selected plug location in the well, the plugging fluid can be displaced through the string of pipe and into the support pipe. The plugging fluid will exit the support pipe through the openings therein above the fluid barrier. The fluid barrier will catch the plugging fluid that exits the support pipe. Once a sufficient amount of plugging fluid has been displaced into the well, the plugging fluid is allowed to harden or gel sufficiently such that it will support its own weight in the well. Once this occurs, the string of pipe utilized to lower the apparatus into the well is removed therefrom. The string of pipe may be removed by utilizing a chemical cutting tool or by utilizing a shear activated coupling device to attach the string of pipe to the support pipe to allow the string of pipe to be removed.

Further objects, features and advantages of the present invention will be understood from the following description when read in conjunction with the accompanying drawings.

DETAILED DESCRIPTION OF THE PREFERRED EMBODIMENT

Figure 1:
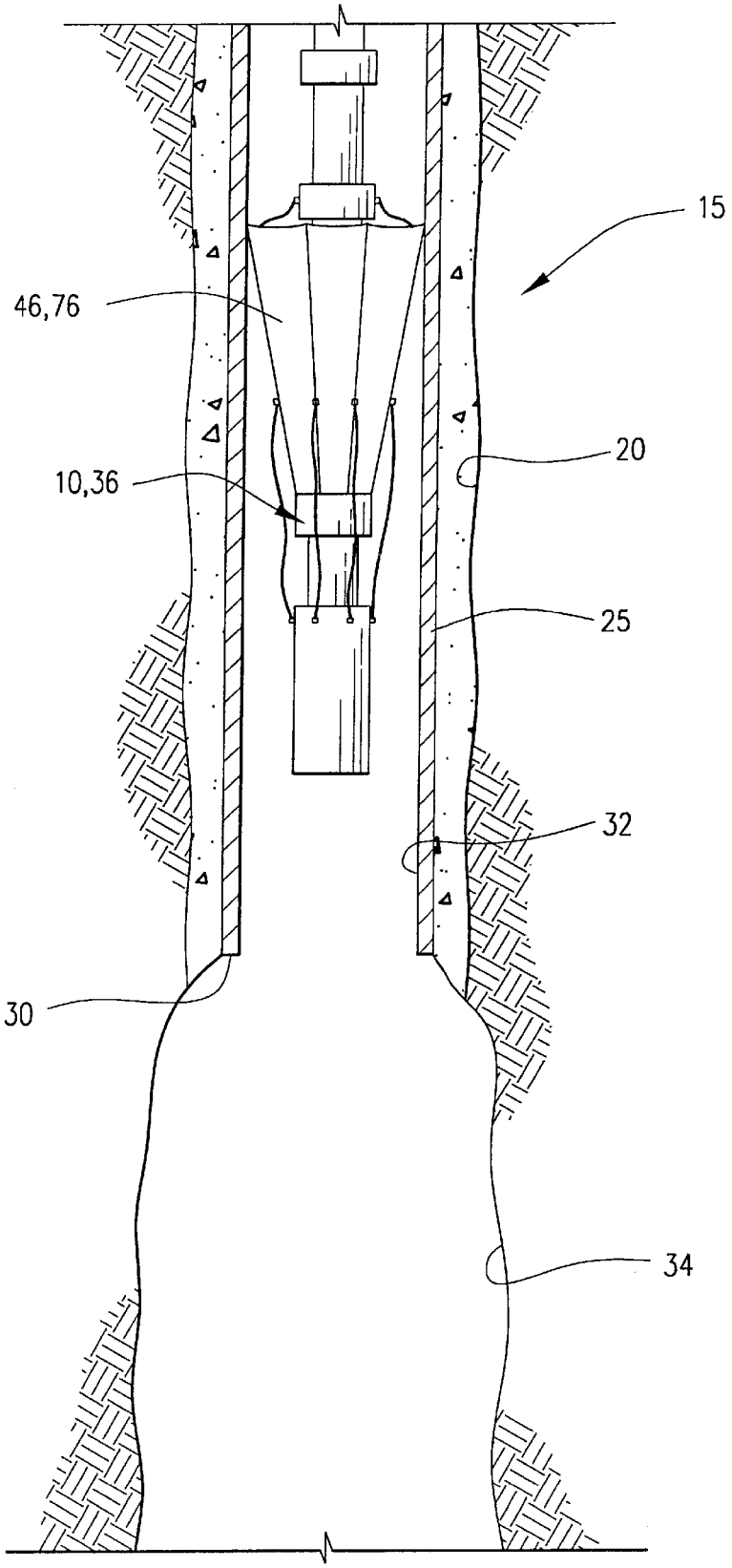
FIG. 1 Schematically shows the plugging apparatus of the present invention being lowered into a well.
Figure 2:
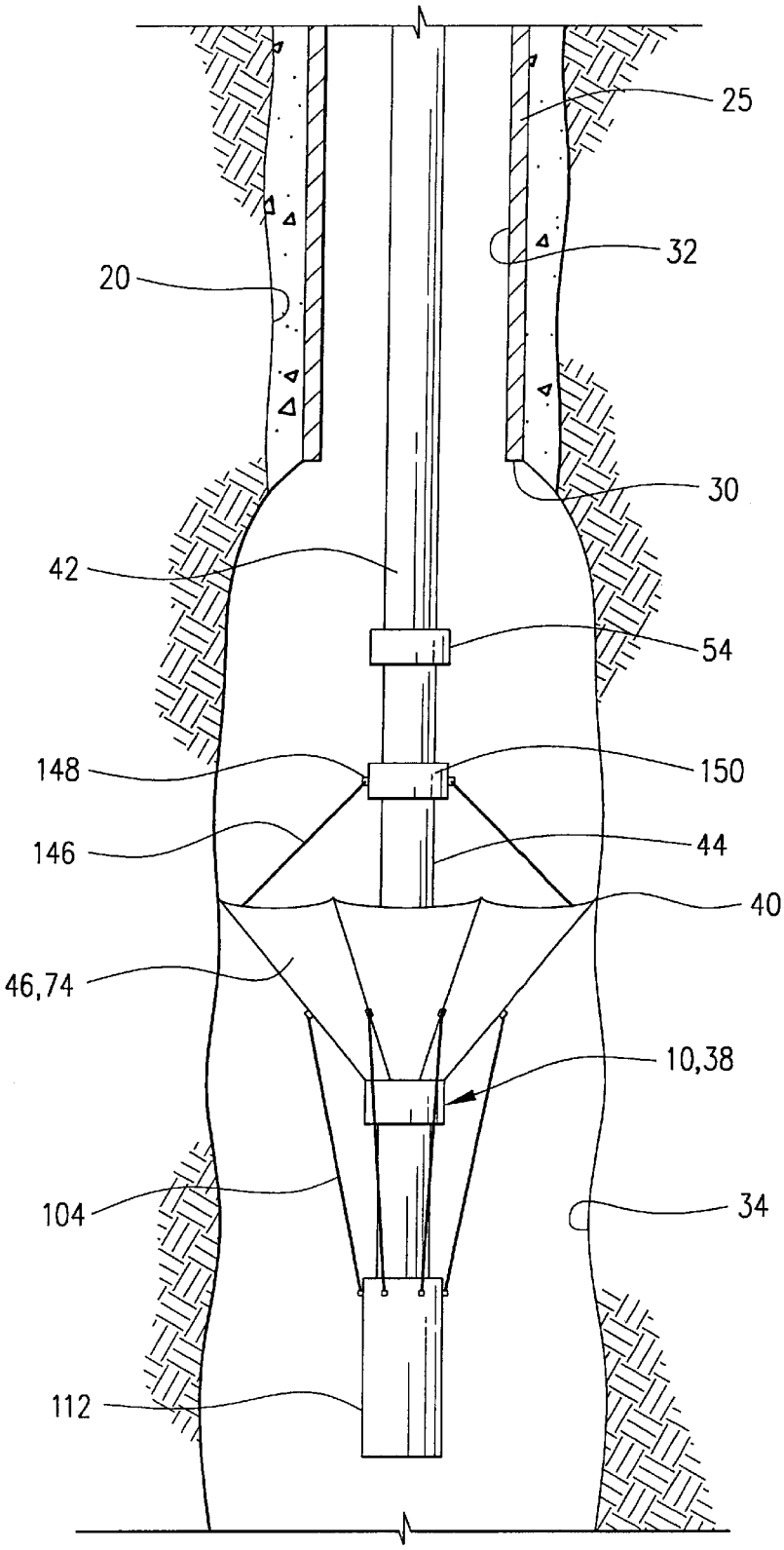
FIG. 2 schematically shows the plugging apparatus of the present invention at the desired plug location in a well.

Referring now to the drawings and more particularly to FIG. 1, the plugging apparatus, or apparatus for plugging wellbores of the present invention is schematically shown and generally designated by the numeral 10. Plugging apparatus 10 is schematically shown being lowered into a well 15 which comprises a wellbore, or borehole 20 having a casing 25 cemented therein. Casing 25 has a lower end 30 and an inner surface 32. Apparatus 10 is shown in its closed position 36 in FIG. 1, and is schematically shown in its open position 38 in FIG. 2 at a selected plug location 40 in well 15. In the embodiment shown, the selected plug location is in the uncased portion 34 of well 15. If desired, however, the apparatus can be used in a casing, liner or other pipe positioned in a well. Likewise, the apparatus can be lowered through any kind of casing and/or liner in a wellbore. Apparatus 10 can be lowered with a pipe string or tubing 42 of any type and material known in the art.

Figure 3:
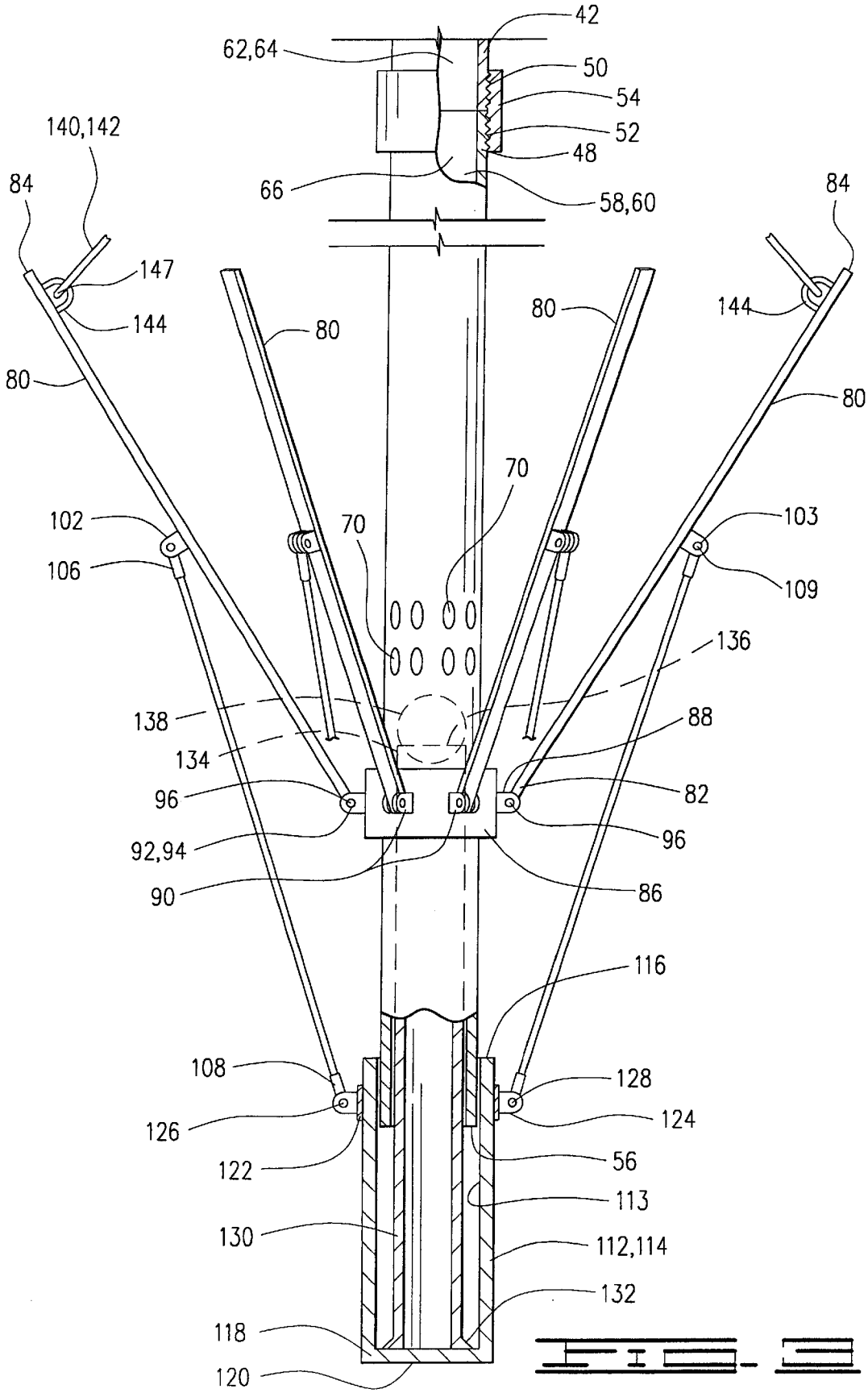
FIG. 3 is a partial section elevation view of the plugging apparatus of the present invention. The material which comprises the fluid barrier to catch the plugging fluid is not shown in FIG. 3.
Figure 4:
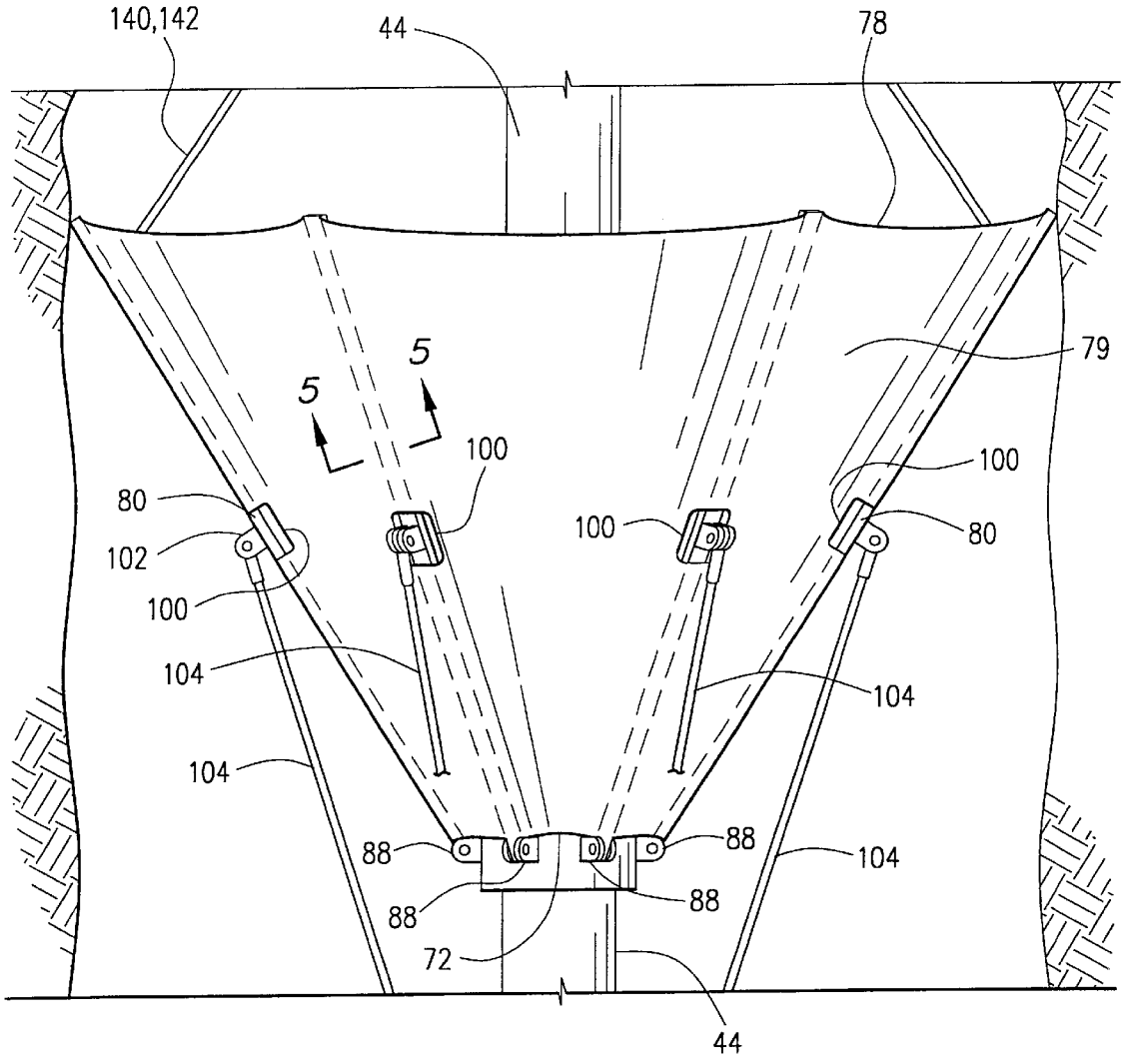
FIG. 4 shows a portion of the apparatus of the present invention with the fluid barrier opened to engage a wellbore.
Figure 5:
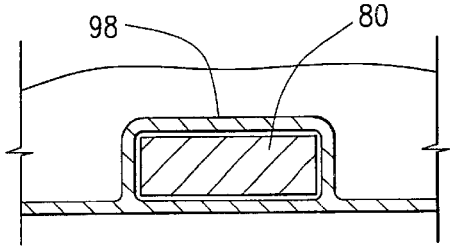
FIG. 5 shows a cross section from FIG. 5—5 in FIG. 4.

Referring now to FIGS. 3 and 4, apparatus 10, which may also be referred to as a well barrier 10, comprises a support pipe 44 and a fluid basket or fluid barrier 46. Fluid barrier 46 is disposed about support pipe 44.

Support pipe 44 has an upper end 48 adapted to be connected to a lower end 50 of pipe string 42. Thus, upper end 48 may have threads 52 defined thereon having a coupling 54 connected thereto. Coupling 54 can then be threadedly connected to lower end 50 of pipe string 42.

Support pipe 44 also has a lower end 56, an interior or central opening 58, and an exterior, or outer surface 59. Opening 58 defines a support pipe flow passage 60. Pipe string 42 has an interior or opening 62 defining a pipe string flow passage 64. Flow passage 60 is communicated with flow passage 64 such that the two may be referred to collectively as a longitudinal central flow passage 66. A plurality of flow ports 70 which are preferably radial flow ports are defined in support pipe 42 and communicate longitudinal flow passage 68 and specifically support pipe flow passage 60 with well 15.

Fluid barrier 46 is disposed about support pipe 44 below flow ports 70. As seen in FIG. 4, fluid barrier 46 has an opening 72 at a radially inner portion thereof through which support pipe 44 is received. When apparatus 10 is in its open position 38 which may also be referred to as an open position 74 of the fluid barrier, fluid barrier 46 extends radially outwardly and upwardly from the support pipe so that it will receive a plugging fluid, as will be explained in more detail hereinbelow. Closed position 36 of apparatus 10 may also be referred to as a closed position 76 of the fluid barrier.

Barrier 46 extends outwardly from opening 72 to an outer periphery or outer edge 78. Barrier 46 comprises a webbing 79 which will be referred to herein as a canvas or canvas-like material. Canvas-like webbing 79 may be made of fabric, a plastic or any material that has sufficient strength to hold a plugging fluid and that will fold and give as it moves from its open to its closed positions. Thus, the webbing may be referred to as foldable, and may be a fabric, a plastic or any other material having such qualities.

Fluid barrier 46 may also include a plurality of support stays or support members 80. Support members 80 are rigid or semi-rigid members of sufficient strength to support the weight of a column of the plugging fluid. The number of support members 80 may vary, depending on wellbore geometry and the load-carrying requirements of the apparatus 10, which will be determined based on the amount of plugging fluid to be used. While members 80 may have some flex, they must be of sufficient strength so that they will not bend to the point of failure, thus allowing plugging fluid to be displaced around and below the fluid barrier. Members 80 have an inner end 82 and an outer end 84. Outer end 84 preferably extends outwardly so that it is at or almost at outer periphery 78 of webbing 79. Support members 80 are hingedly connected to support pipe 44 and are preferably hingedly connected to a collar 86 that is attached by welding or other means to support pipe 44. A plurality of lugs 88 are connected to collar 86. Lugs 88 comprise a pair of spaced-apart lug members 90 each having openings 92 therein. Each support member 80 has an opening 94 defined at its inner end 82 thereof A bolt 96 or other type of pin known in the art can be inserted through openings 92 and 94 so that each support stay 80 is hingedly connected at its inner end thereof to support pipe 44. Because each support member 80 is hinged at its lower end, each support member 80 will pivot, or rotate about pins 96 independent of the movement or rotation of any other of the plurality of support member 80. Thus, each support member can rotate outwardly to engage the well even in those instances where the selected plug location is at a section of the well which is not round.

Support members 80 are attached to webbing 79. Thus, webbing 79 may include sleeves 98 in which support stays 80 are received and held. Sleeves 98 have an opening 100 therein so that a portion of each support member is exposed. The exposed portion of each support member 80 at opening has an attachment hook 102 defining an opening 103. Sleeve 98 may also have an opening at the radial inner end thereof so that inner ends 82 of members 80 may extend therethrough and be attached to lugs 88.

A plurality of deployment cables or rods 104 are attached at a first end 106 to support members 80. In the embodiment shown, two deployment cables or rods 104 are utilized. It is not necessary that two be used and more than two may be used. Cables or rods 104 are attached at first end 106 utilizing a pin 109 extending through an opening defined at end 106 of cable 104 that also extends through opening 103 defined by attachment hook 102. The pin may be a bolt or other fastening means known in the art. Deployment cable 104 has a second end 108 also having an opening therein. Deployment cable 104 is attached at a second end 108 to a deployment weight 112.

Deployment weight 112 comprises generally cylindrical housing 114 defining a central opening 113. Housing 114 has an open upper end 116 and a closed lower end 118. A cap 120 is therefore disposed at the lower end 118 of weight 112. Deployment weight 112 may include a collar 122 welded or otherwise attached thereto. Collar 122 has lugs 124 connected to and extending therefrom having openings 126 therein. Cables 104 are attached at lower ends 108 to lugs 124 with a pin 128 or other means known in the art extending through openings 126 and the opening in second end 108 of cable 104.

As shown in FIG. 3, support pipe 44 extends downwardly beyond upper end 116 of deployment weight 112 and is received in central opening 113. Deployment weight 112 and cables or rods 104 may be referred to as an opening means or a deployment means for deploying fluid barrier 46.

Apparatus 10 further includes a ball seat support 130. Ball seat support 130 has a lower end 132 weided or otherwise attached to cap 120 such that flow therethrough is not permitted. Ball seat support 130 also has an upper end 134 which defines a ball seat 136 for receiving a ball 138.

Apparatus 10 may also include an arresting means 140 which comprises cables 142 attached to support pipe 44 and to lugs 144 which are connected to support members 80. Lugs 144 will extend through openings in webbing 79 which are similar to openings 100 in sleeves 98. Cables 142 have upper ends 146 and lower ends 147. Upper ends 146 are attached to lugs 148 which are preferably connected to a collar 150 attached to support pipe 44. Lower end 147 of cables 142 is attached to lugs 144. The attachment of cable 142 may be with pins, bolts or other fasteners or means known in the art.

The operation of the invention is as follows. Well barrier 10 is lowered into well 15 on pipe string 42. Prior to lowering the apparatus into the well, well geometry at the selected plug location can be established with a caliper log, and the fluid barrier can be sized to engage the well and open to an optimum position at the plug location. The apparatus is in its closed position 36 such that fluid barrier 46 is in its closed position 76 as the apparatus 10 is being lowered into the well. Apparatus 10 may be held in its closed position by releasable straps wrapped around fluid barrier 46, for example straps having VELCRO® ends connected to one another, or may be simply allowed to rest against the inner surface of the casing and the uncased portion of the well as it is lowered to selected plug location 40. If such straps are used as temporary restraints, deployment will not be impaired, since, as apparatus 10 passes below lower end 30 of casing 15, deployment weight 112, which pulls downwardly on support members 80 will cause fluid barrier 46 to open. Because each support member 80 is individually hinged, each member will pivot outwardly so that the upper end thereof will engage the well. Cables 142 will prevent the fluid barrier from opening past a predetermined fully open position. If desired, webbing 79 may be sized and be of sufficient strength to support itself in the fully open position, so long as the tensile strength of the material for webbing 79 is not exceeded. Apparatus 10 is continued to be lowered into the wellbore until it reaches selected plug location 40. At the selected plug location, fluid barrier 44 will engage the well at the open hole portion 34 thereof Because each support member pivots independently of the other support members, fluid barrier 46 will engage the wellbore around the circumference thereof, even in situations where the wellbore is not round.

As is apparent from the drawings, when apparatus 10 is in open position 38, upper end 134 of ball seat 130 will be below fluid ports 70. When apparatus 10 is in its closed position 36, upper end 134 of sleeve 130 may be above ports 70. In closed position 36, lower end 56 of support pipe 44 will extend downwardly further into deployment weight 112 than in open position 38 which is shown in FIG. 3.

Continuing with the operation, once the selected plug location 40 has been reached, barrier 46 will be in its open position 38, and brine water, fresh water or other solutions may be displaced into the well to prepare the well for plugging. The water pumped into the wellbore prior to the plugging fluid being pumped may also act as a spacer as is known in the art. Ball 138 may be displaced through pipe string 42 and support pipe 44 until it engages ball seat 136. Once ball seat 136 is engaged, the fresh water or other fluid spacer may be pumped if desired. Plugging fluid, which is preferably a cement, but which may be any type of plugging fluid, is then displaced through flow passage 66 and outwardly through flow ports 70. Fluid pressure acting on ball 138 will push sleeve 130 and thus weight 112 downwardly, maintaining apparatus 10 in its open position so that fluid barrier 46 stays engaged around at least a substantial portion of the circumference of the well 15 at selected plug location 40. If a ball is not used, pressure differential across deployment weight 112 can be used to hold the apparatus open.

As plugging fluid is communicated through ports 70, it will be caught by fluid barrier 46. Plugging fluid is continually displaced until a sufficient amount of plugging fluid to plug the wellbore has been displaced into the wellbore. The plugging fluid is allowed to harden, or gel such that it will support its own weight in the well. A chemical cutter is then lowered into the well and the tubing may be cut at the top of the cement plug so that pipe string 12 may be removed therefrom.

Apparatus 10 can also be released from pipe string 42 by applying tensile force to a shear activated coupling device. Thus, apparatus 10 may also be connected to pipe string 42 with a shear sub. The shear sub may be constructed with two threaded couplings, one attached to the lower end of pipe string 42 and the other connected to support pipe 44. The two coupling components may be connected to each other with shear pins made from steel, aluminum, brass, or any other desired materials. Once apparatus 10 has been deployed in position 34 and the plugging fluid has set, apparatus 10 may be released from pipe string 42 by pulling tension on the pipe string to shear the pins. Alternatively, there are other means of accomplishing the release such as pumping a wiper ball to seat on the lower section of the coupling device, and allowing the coupling device to be sheared by means of applying pressure.

Other well known means may be employed to release apparatus 10, such as a ball seat and wiper ball deployed as components of the shear activated coupling device, which would cause pins to shear in response to pressure. Further, if it is desired to hold apparatus 10 in the well while operations are carried out above apparatus 10, the pipe string can be perforated with explosive charges, as is well known in the art.

It is therefore seen that the apparatus and method of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. Apparatus for plugging an uncased portion of a well comprising:

a pipe string lowered through a casing in said well, the pipe string having a length sufficient to extend to said uncased portion of said well below said casing, said pipe string defining a central flow passage therethrough;

a support pipe connected to said pipe string, said support pipe defining a central flow passage and defining a plurality of openings therethrough intersecting said central flow passage of said support pipe;

a fluid barrier for permanent placement in said well, said fluid barrier being disposed about said support pipe below said plurality of openings for catching a plugging fluid displaced through said central flow passages of said pipe string and said support pipe and communicated through said openings in said support pipe, said pipe string comprising a removable pipe string adapted to be removed from said well after a sufficient amount of plugging fluid has been communicated through said openings to completely plug said well and after said plugging fluid has sufficiently hardened to support itself in said well.

2. The plugging apparatus of claim 1, wherein said fluid barrier comprises a canvas material.

3. The plugging apparatus of claim 2, further comprising a plurality of support members for supporting said canvas material connected to said support pipe.

4. The apparatus of claim 3 wherein said support members are hingedly connected to said support pipe.

5. The apparatus of claim 1, said fluid barrier comprising an upwardly opening barrier extending radially outwardly from said support pipe around the circumference thereof.

6. The apparatus of claim 1, wherein said fluid barrier is movable in said well from a closed position to an open position.

7. The apparatus of claim 6, said fluid barrier comprising a canvas-like material and a plurality of support members for supporting said canvas-like material, said support members extending, radially outwardly from said support pipe.

8. The apparatus of claim 7, wherein said support members are hingedly connected to said support pipe.

9. The apparatus of claim 7, further comprising an arresting means for preventing said support members from overrotating past said open position of said fluid barrier.

10. The apparatus of claim 9, said arresting means comprising a plurality of cables attached at one end to said support pipe and at a second end to said support members.

11. It The apparatus of claim 7, wherein said support members are substantially rigid support members.

12. The apparatus of claim 1, said support pipe being adapted at an upper end thereof to be connected to a pipe string and lowered into said wellbore thereon.

13. Apparatus for plugging a well in an uncased portion thereof, comprising:

a pipe string disposed in said well;

a support pipe connected to a lower end of said pipe string, said pipe string and said support pipe defining a longitudinal flow passage, wherein a plurality of flow ports intersect said flow passage and communicate said flow passage with said well, said pipe string and said well defining an annulus therebetween in said cased and said uncased portion of said well; and a fluid barrier disposed about said support pipe below said flow ports for catching a plugging fluid communicated through said flow ports into said well, wherein said pipe string is adapted to be removed from said well after a desired amount of said plugging fluid is communicated through said flow ports.

14. The apparatus of claim 13, said fluid barrier comprising a canvas-like material disposed about said support pipe and a plurality of support members extending radially from said support pipe for supporting said canvas-like material.

15. The apparatus of claim 14, wherein said fluid barrier engages said wellbore when said fluid barrier is positioned at a selected plug location.

16. The apparatus of claim 14, wherein said support members are hingedly connected to said support pipe at radially inner ends thereof.

17. The apparatus of claim 13, further comprising a ball seat disposed in said support pipe for receiving a ball displaced into said support pipe and to direct fluid through said flow ports.

18. A method of plugging a well comprising:

connecting a well barrier to a pipe string;

lowering said well barrier in said well to a selected plug location with said pipe string;

placing said well barrier into engagement with said well at said selected plug location;

displacing a plugging fluid downwardly in said pipe string;

communicating said plugging fluid into said well above said well barrier, while said well barrier is connected to said pipe string; and removing said pipe string from said wellbore after a desired amount of plugging fluid has been disposed into said well.

19. The method of claim 18, comprising allowing said plugging fluid to harden sufficiently to support its own weight in said well prior to removing said pipe string.

20. The method of claim 18, further comprising:

determining dimensional characteristics of said well at said selected plug location prior to lowering said barrier into said well; and sizing said barrier such that said well barrier will engage said well at said selected plug location.

21. The method of claim 18, further comprising:

catching said plugging fluid with said well barrier;

allowing said plugging fluid to harden; and removing said pipe string from said wellbore.

22. The method of claim 21, wherein said removing step comprises:

cutting said pipe string above said well plug; and withdrawing said well barrier.

23. The method of claim 18, further comprising:

securing said fluid barrier in a closed position prior to lowering said barrier to said selected location, said placing step comprising moving said barrier from said closed to an open position wherein said fluid barrier engages said wellbore.

24. Apparatus for plugging a well comprising:

a support pipe defining a central flow passage and defining a plurality of openings therethrough intersecting said central flow passage;

a fluid barrier disposed about said support pipe below said plurality of openings for catching a plugging fluid displaced through said flow passage and communicated through said openings in said support pipe;

a plurality of support members hingedly connected to said support pipe for supporting said fluid barrier;

said fluid barrier being movable from a closed to an open position; and a deployment weight connected to said support members, wherein said weight causes said support members to rotate outwardly from said closed to said open position so that said fluid barrier engages said wellbore at a selected plug location.

25. Apparatus for plugging a well comprising:

a pipe string disposed in said well;

a support pipe connected to a lower end of said pipe string, said pipe string and said support pipe defining a longitudinal flow passage, wherein a plurality of flow ports intersect said flow passage and communicate said flow passage with said well;

a fluid barrier disposed about said support pipe below said flow ports for catching a plugging fluid communicated through said flow ports into said well; and a deployment weight attached to said fluid barrier, wherein said weight causes said barrier to move from a closed to an open position in said well.

26. The apparatus of claim 25, further comprising arresting means for preventing said barrier from opening beyond a predetermined fully open position.

27. The apparatus of claim 25, said weight being disposed about said support pipe and slidable relative thereto.

28. The apparatus of claim 27, said weight being connected to at least a portion of said support members.

29. The apparatus of claim 27, said weight comprising a housing having an open upper end and a closed lower end, said support pipe being received in the upper end of said housing.

30. The apparatus of claim 29, further comprising a ball seat sleeve disposed in said housing and adapted to receive a ball displaced into said support pipe, wherein said sleeve extends upwxardly into said support pipe so that an upper end of said sleeve is positioned below said flow ports when said fluid barrier is positioned in said well at a selected plug location.

31. Apparatus for plugging a well comprising:

a pipe string disposed in said well;

a support pipe connected to a lower end of said pipe string, said pipe string and said support pipe defining a longitudinal flow passage, wherein a plurality of flow ports intersect said longitudinal flow passage and communicate said longitudinal flow passage with said well;

a fluid barrier disposed about said support pipe below said flow ports for catching a plugging fluid communicated through said flow ports into said wells; and said fluid barrier comprising a canvas-like material disposed about said support pipe and a plurality of support members extending radially from said support pipe for supporting said canvas-like material wherein said support members are hingedly connected to said support pipe at radially inner ends thereof.

32. A method of plugging an uncased portion of a well comprising:

connecting a fluid barrier to a pipe string, the fluid barrier comprising a foldable material having a plurality of support members attached thereto, the support members being pivotably connected at a first end to a support pipe, wherein said support members pivot independently of one another, said support members having second ends for engaging said uncased portion of said well;

lowering said fluid barrier on said pipe string to a desired plug location in said uncased portion of said well, wherein second ends of said support members engage said uncased portion of said well at said plug location;

displacing a plugging fluid through said pipe string; and communicating said plugging fluid into said well above said fluid barrier while said barrier is connected to said pipe string.

33. The method of claim 32, further comprising supporting the weight of said fluid barrier and said plugging fluid in said well with said pipe string without a packer in said well.

34. The method of claim 36 further comprising removing said pipe string after said plugging fluid has hardened such that it will support its own weight in said well.

35. A method of plugging a well comprising:

connecting a well barrier to a pipe string;

lowering said well barrier with said pipe string to a selected plug location in said well;

engaging said well with said well barrier at said selected plug location;

displacing a plugging fluid through said pipe string;

communicating said plugging fluid into said well;

catching said plugging fluid with said well barrier;

supporting said plugging fluid with said pipe string without a packer in said well; and removing said pipe string from said well after a desired amount of plugging fluid has been displaced therethrough.

36. The method of claim 35, removing step comprising removing said pipe string after said plugging fluid has hardened sufficiently to support its own weight in said well.

37. The method of claim 35, wherein said lowering step comprises lowering said fluid barrier into an uncased portion of said well.

38. The method of claim 37, wherein said uncased portion of said well is located below a cased portion of said well.

39. Apparatus for plugging a well at a selected plug location, the apparatus comprising:

a pipe string lowered into said well, said pipe string defining a central flow passage;

a support pipe connected to said pipe string, said support pipe defining a central flow passage communicated with said central flow passage of said pipe string and defining a plurality of openings therethrough intersecting said central flow passage of said support pipe;

a fluid barrier disposed about said support pipe below said plurality of openings;

a plurality of fluid barrier supports pivotably connected to said support pipe and attached to said fluid barrier; and a deployment weight for exerting a downward force on at least a portion of said fluid barrier supports so that said supports will rotate outwardly from said support pipe to cause said fluid barrier to engage said well.

40. The apparatus of claim 39, wherein said fluid barrier supports pivot independently of one another.

41. The apparatus of claim 39, wherein said deployment weight is attached to all of said fluid barrier supports to apply a downward pulling force thereto.

42. The apparatus of claim 41, wherein each fluid barrier support is adapted to engage said well at said plug location when said plug location is an uncased, irregular shaped portion of said well.

43. Apparatus for plugging an uncased portion of a well, the apparatus comprising:

a pipe string, lowered into said well;

a support pipe connected to said pipe string;

a fluid barrier disposed about said support pipe, wherein a plugging fluid may be displaced through said pipe string and communicated into said well above said fluid barrier so that said fluid barrier will catch said plugging fluid; and a plurality of rigid or semi-rigid fluid barrier supports attached to said fluid barrier, wherein said supports have first and second ends and are movable independently of one another, so that the second ends of each said support will engage said uncased portion of said well at a desired plug location.

44. The apparatus of claim 43, wherein said first end of said fluid barrier supports is pivotally connected to said support pipe.

45. The apparatus of claim 44, further comprising a deployment weight connected to said fluid barrier supports for moving said fluid barrier to an open position in said well.

46. A method of plugging an uncased portion of a well comprising:

connecting a fluid barrier to a pipe string;

lowering said fluid barrier into said well on said pipe string to a selected plug location;

applying a downward pulling force to said fluid barrier to hold said fluid barrier in an open position wherein said fluid barrier engages said well at said selected plug location;

displacing a plugging fluid through said pipe string;

communicating said plugging fluid from said pipe string into said well above said fluid barrier; and increasing the downward pulling force on said fluid barrier after said fluid barrier reaches said selected plug location.

47. The method of claim 46, wherein said applying step comprises attaching a deployment weight to said fluid barrier.

48. The method of claim 47, wherein said increasing step comprises pushing said deployment weight downwardly with plugging fluid displaced through said pipe string.

49. Apparatus for plugging a well comprising:

a support pipe lowered into said well;

a fluid barrier connected to said support pipe for catching a plugging fluid communicated into said well; and a deployment weight connected to said fluid barrier for moving said fluid barrier to an open position in said well.

50. The apparatus of claim 49, wherein said deployment weight is slidably disposed about said support pipe.

51. The apparatus of claim 50, said deployment weight being disposed about the lower end of said support pipe, the apparatus further comprising:

a sleeve mounted in said deployment weight, said sleeve having a seat for receiving a ball displaced into said support pipe, wherein said sleeve extends upwardly into said support pipe.

* * * * *